US008584860B2

(12) United States Patent
Orischak et al.

(10) Patent No.: US 8,584,860 B2
(45) Date of Patent: Nov. 19, 2013

(54) CONVERTIBLE CARTON

(75) Inventors: Douglas William Orischak, Hunker, PA (US); Thomas Wray McCarthy, Pittsburgh, PA (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 13/242,440

(22) Filed: Sep. 23, 2011

(65) Prior Publication Data

US 2012/0074037 A1 Mar. 29, 2012

Related U.S. Application Data

(60) Provisional application No. 61/387,159, filed on Sep. 28, 2010.

(51) Int. Cl.
*B65D 5/50* (2006.01)

(52) U.S. Cl.
USPC ..... 206/736; 206/738; 206/746; 206/774; 206/775

(58) Field of Classification Search
USPC ..... 229/118, 122.22, 122.24, 200, 207, 229/237, 243–244, 185.1, 162.3, 162.7, 229/164, 240, 122; 206/736, 738, 774–746, 206/781–782, 459.5, 831
See application file for complete search history.

(56) References Cited

U.S. PATENT DOCUMENTS

| | | | | | |
|---|---|---|---|---|---|
| 2,018,707 | A * | 10/1935 | Daller | 206/773 |
| 4,688,716 | A * | 8/1987 | Winterling | 229/137 |
| 4,871,067 | A * | 10/1989 | Valenti | 206/427 |
| 5,657,872 | A * | 8/1997 | Leftwich et al. | 206/738 |
| 5,697,549 | A * | 12/1997 | Yocum | 229/400 |
| 5,722,584 | A * | 3/1998 | Fujiwara | 229/120.15 |
| 5,950,914 | A * | 9/1999 | Dunton et al. | 229/122 |
| 6,510,982 | B2 * | 1/2003 | White et al. | 229/235 |
| 7,992,765 | B2 * | 8/2011 | Brand | 229/122.1 |

* cited by examiner

*Primary Examiner* — Andrew Perreault
*Assistant Examiner* — James M Van Buskirk
(74) *Attorney, Agent, or Firm* — Ungaretti & Harris LLP

(57) ABSTRACT

The present invention provides a foldable shipping carton that easily converts to a retail display. The carton of the present invention incorporates an integral detachable panel that protects the product and the product's primary graphics area. Once at a retail location, the detachable panel is removed exposing the graphics. The carton then doubles as a display to draw attention to the product. The carton of the present invention replaces the unattractive brown cardboard shipping box and is intended to build brand awareness and drive sales.

18 Claims, 10 Drawing Sheets

CONVERTIBLE CARTON

CROSS-REFERENCE TO RELATED APPLICATIONS

The present Application claims the benefit of U.S. Provisional Patent Application No. 61/387,159 filed Sep. 28, 2010, the contents of which are incorporated herein by reference.

FEDERALLY SPONSORED RESEARCH OR DEVELOPMENT

Not applicable.

FIELD OF THE INVENTION

The present invention generally relates to a foldable shipping carton that protects the products' primary graphics during transportation and easily converts to a display for the products for use at a store.

DESCRIPTION OF THE PRIOR ART

Products are often shipped in plain cardboard boxes or containers. Product displays for retail establishments are well-known. It is desirable to combine a shipping carton with a retail display.

SUMMARY OF THE INVENTION

The present invention provides a foldable shipping carton that easily converts to a retail display. The carton of the present invention incorporates an integral detachable panel that protects the product and the product's primary graphics area during transportation. Once at a retail location, the detachable panel is removed exposing the graphics. The carton then doubles as a display to draw attention to the product. The carton of the present invention replaces the unattractive brown cardboard shipping box and is intended to build brand awareness and drive sales.

In one embodiment, the present invention provides a blank for forming a foldable carton. The blank includes a front panel having a first side edge and a second side edge, a first side panel having a first side edge attached to the first side edge of the front panel, and a rear panel having a first side edge attached to a second side edge of the first side panel. The blank also includes a second side panel having a first side edge attached to a second side edge of the rear panel, a third side panel having a first side edge attached to the second side edge of the front panel, and an intermediate panel having a first side edge attached to a second side edge of the second side panel. A detachable panel having a first side edge is attached to a second side edge of the intermediate panel. In another embodiment, the present invention provides a convertible carton formed from such single blank of material.

In a further embodiment, the present invention provides a blank for forming a foldable carton. The blank includes a front panel having a first side edge and a second side edge, a bottom panel having a first side edge attached to the first side edge of the front panel, and a rear panel having a first side edge attached to a second side edge of the bottom panel. The blank also includes a top panel having a first side edge attached to the second side edge of the front panel, an intermediate panel having a first side edge attached to a second side edge of the rear panel, and a detachable panel having a first side edge attached to a second side edge of the intermediate panel. In another embodiment, the present invention provides a convertible carton formed from such single blank of material.

In another embodiment, a blank for forming a foldable carton is provided. The blank includes a front panel having a first side edge and a second side edge, a bottom panel having a first side edge attached to the first side edge of the front panel, and a rear panel having a first side edge attached to a second side edge of the bottom panel. The blank also includes a top panel having a first side edge attached to a second side edge of the rear panel, and a detachable panel having a first side edge attached to a second side edge of the top panel. In another embodiment, the present invention provides a convertible carton formed from such single blank of material.

In yet another embodiment of the invention, a foldable carton is provided. The foldable carton comprises a front panel having a first side edge and a second side edge and an opening, a first side panel having a first side edge and a second side edge, the first side edge of the first side panel attached to the first side edge of the front panel, a rear panel having a first side edge and a second side edge, the first side edge of the rear panel attached to the second side edge of the first side panel, a second side panel having a first side edge and a second side edge, the first side edge of the second side panel attached to the second side edge of the rear panel, and a third side panel having a first side edge attached to the second side edge of the front panel. The carton further comprises an intermediate panel having a first side edge and a second side edge, the first side edge of the intermediate panel attached to the second side edge of the second side panel, and a detachable panel having a perforated first side edge and a second side edge, the first side edge of the detachable panel attached to the second side edge of the intermediate panel; wherein the first side panel forms a first side of the carton, and the second side panel and the third side panel collectively form a second side of the carton opposing the first side of the carton.

In accordance with one alternative, the opening extends to a top edge of the front wall. In another alternative, the opening extends to a side edge of the front panel.

The foldable carton is formed from a single blank of material. The blank can be plastic or a paper material.

The intermediate panel can include a hand-hold opening adjacent the second side panel. The hand-hold opening enables one to grasp and detach the intermediate panel and detachable panel from the carton.

The detachable panel can include an indentation adjacent the second side edge of the detachable panel. Additionally, the detachable panel can include a first side tab for gluing to another panel.

The front panel can include a removable tab extending into the opening of the front panel. The removable tab can include a glue portion for securing it to an inside surface of the detachable panel.

The third side panel includes a glue portion. The third panel can be secured to the second side panel via the glue portion.

The foldable carton can further comprise a plurality of top flaps connected respectively to a top end of the front panel, first side panel, second side panel and third side panel for forming a top of the carton. Similarly, the foldable carton can further comprise a plurality of bottom flaps connected respectively to a bottom end of the front panel, first side panel, second side panel and third side panel for forming a bottom of the carton.

In another alternative embodiment, a convertible carton is provided. The convertible carton comprises a front panel having an opening, a bottom edge and a top edge, a bottom panel having a front edge connected to the bottom edge of the front panel and a rear edge, and a rear panel having a bottom edge connected to the rear edge of the bottom panel and a top edge. Additionally, the convertible carton comprises an intermediate panel having a first edge connected to the top edge of the rear panel and an opposing second edge, a detachable panel having a perforated edge connected to the second edge of the intermediate panel, and a first top panel segment a front edge connected to a first side of the top edge of the front panel and a second top panel segment separated from the first top panel segment by an opening, the second top panel segment having a front edge connected to a second side of the top edge of the front panel.

Again, the carton can be formed from a single blank of material. The blank can be plastic or paper.

The convertible carton can further comprise a side flap extending from a first side of the front panel and a second side flap extending from a second side of the front panel. The first side flap can include a first glue portion and the second side flap including a second glue portion. The detachable panel can include a first side tab extending outward from a first side of the detachable panel and a second side tab extending outward from a second side of the detachable panel. The first side tab positioned to contact the first glue portion of the first side flap and the second side tab positioned to contact the second glue portion of the second side flap.

The convertible carton can further comprise a first hand-hold cut-out on a first side of the detachable panel and a second hand-hold cut-out on a second side of the detachable panel.

The first top panel segment includes a glue portion proximate a rear edge, and the second top panel segment includes a glue portion proximate a rear edge.

Further aspects of the invention are disclosed in the description of the invention including the Figures.

BRIEF DESCRIPTION OF THE DRAWINGS

To understand the present invention, it will now be described by way of example, with reference to the accompanying Figures in which.

DETAILED DESCRIPTION

While this invention is susceptible of embodiments in many different forms, there is shown in the Figures and will herein be described in detail preferred embodiments of the invention with the understanding that the present disclosure is to be considered as an exemplification of the principles of the invention and is not intended to limit the broad aspect of the invention to the embodiments illustrated.

Figure 1:
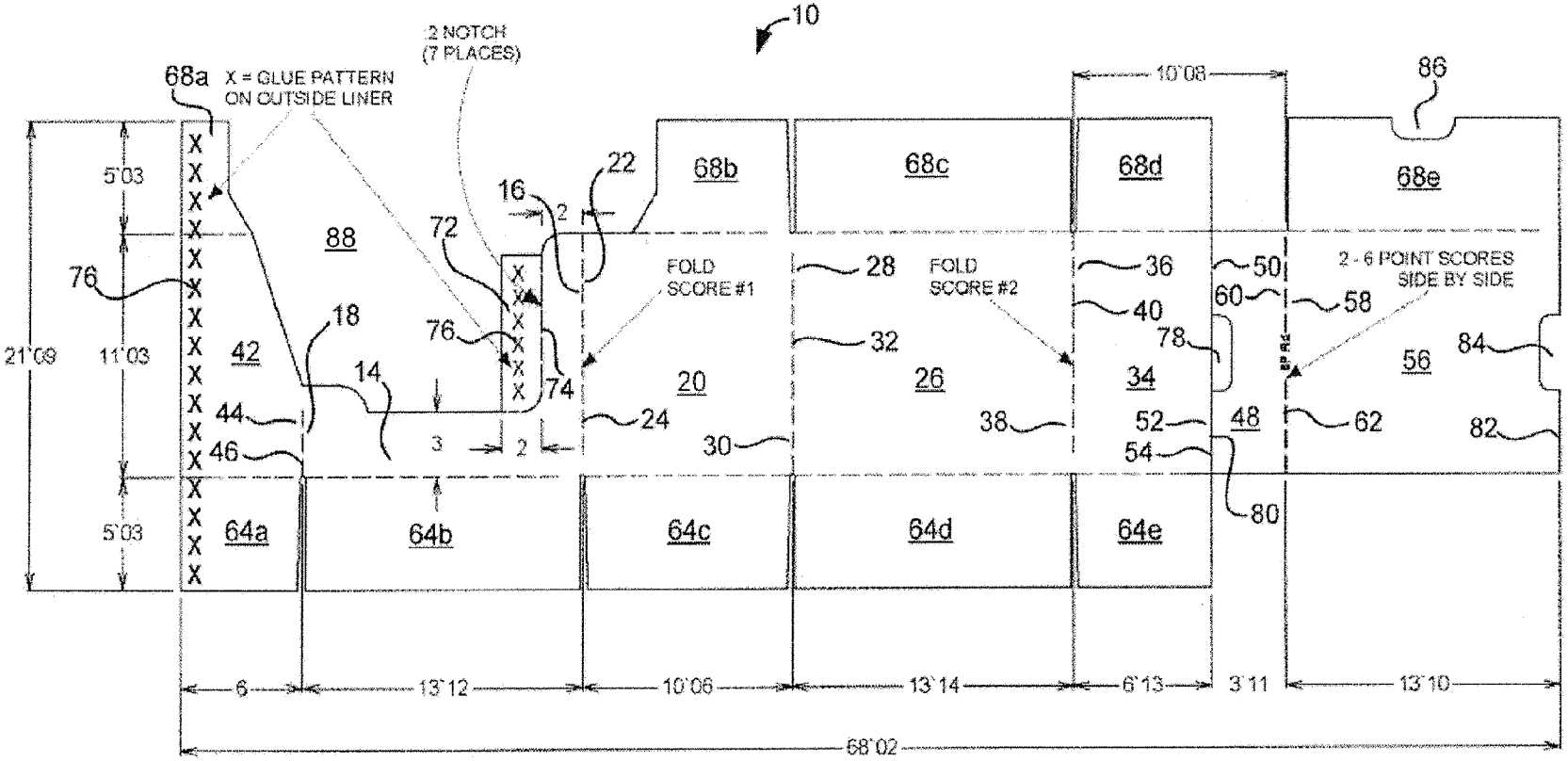
FIG. 1 is a top plan view of a carton blank in accord with a first embodiment of the present invention.
Figure 5:
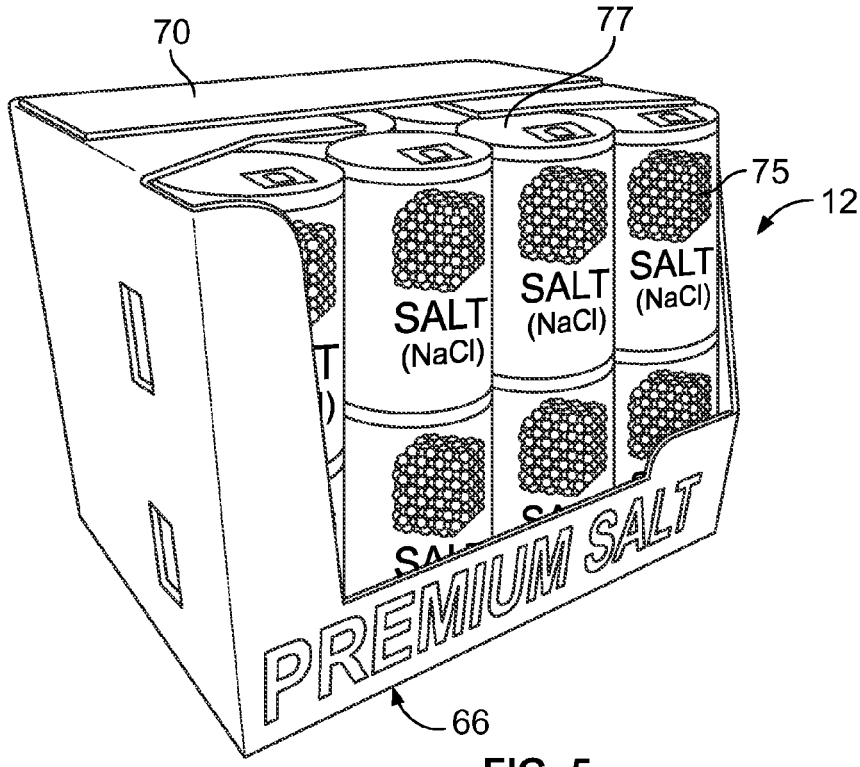
FIG. 5 is a perspective view of a carton formed from the blank of FIG. 1.
Figure 9:
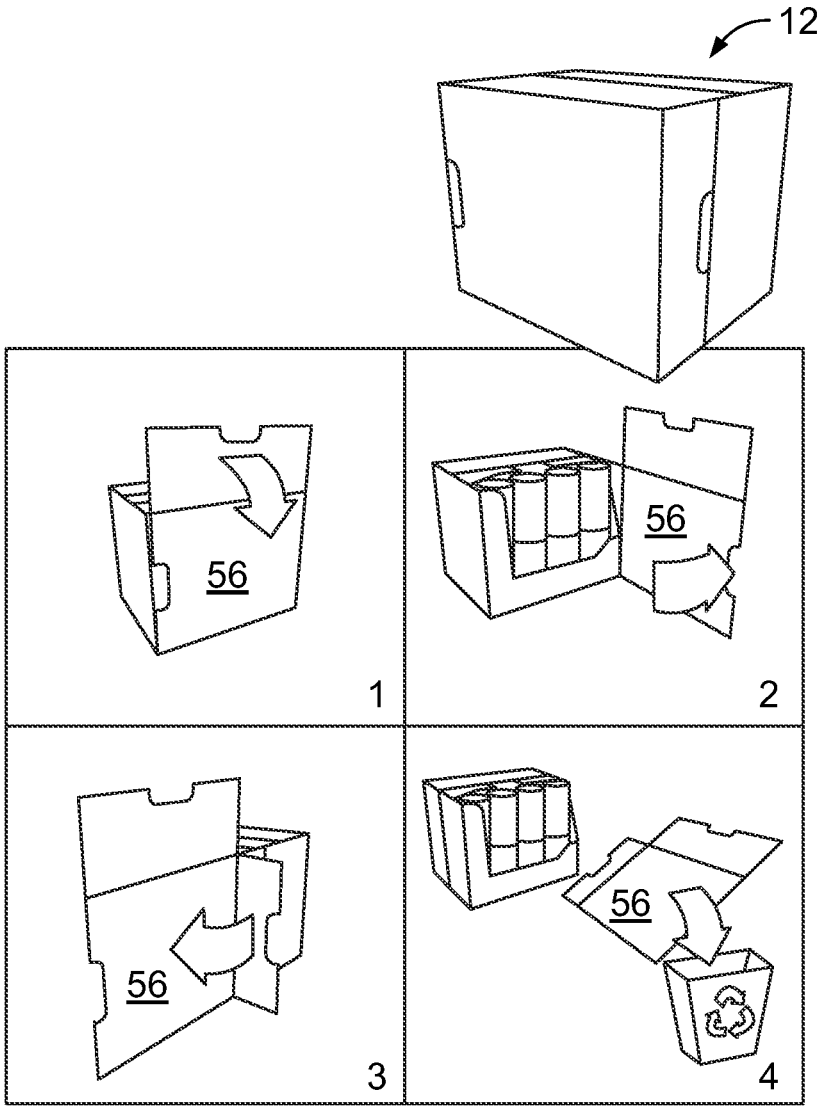
FIG. 9 is an assembly drawing showing how to convert the assembled carton of FIG. 5 into a retail display in accord with an embodiment of the present invention.

Referring to FIGS. 1, 5, and 9, a foldable carton 12 and a blank 10 for forming the foldable carton 12 are shown. The blank 10 is created from a foldable material, such as paper, cardboard, or plastic. The blank 10 is cut (such as die cut) to the appropriate shape. Additionally, the blank 10 is formed to include a plurality of fold lines, perforations, and/or tear lines to facilitate folding the blank 10 into a carton 12 as shown in FIG. 5. FIG. 1 shows the interior side of the blank 10.

In one embodiment, the blank 10 includes a front panel 14 having a first side edge 16 and a second side edge 18. A first side panel 20 having a first side edge 22 is attached to the first side edge 16 of the front panel 14 by a fold line 24. The first side panel 20 forms one side of the completed carton 12. A rear panel 26 having a first side edge 28 is attached to a second side edge 30 of the first side panel 20 by a fold line 32. A second side panel 34 having a first side edge 36 is attached to a second side edge 38 of the rear panel 26 by a fold line 40. A third side panel 42 having a first side edge 44 is attached to the second side edge 18 of the front panel 14 by a fold line 46. The second side panel 34 and the third side panel 42 are combined (e.g., glued together to form a second side wall for the completed carton 12. An intermediate panel 48 having a first side edge 50 is attached to a second side edge 52 of the second side panel 34 by a fold line 54. A detachable panel 56 having a first side edge 58 is attached to a second side edge 60 of the intermediate panel 48 by a fold line 62. When constructed, the intermediate panel is generally positioned over the third side panel 42 and the detachable panel 56 is positioned over the front panel 14.

Each of the front panel 14, first side panel 20, rear panel 26, second side panel 34, and third side panel 42 include downward extending bottom flaps 64*a* through 64*e* for forming a bottom 66 of the finished carton 12. Each of the first side panel 20, rear panel 26, second side panel 34, detachable panel 56, and third side panel 42 include upwardly extending top flaps 68*a* through 68*e* for forming a portion of a top 70 of the finished carton 12. FIG. 5 shows the top 70 after removal of the top flap 68*e* connected to the detachable panel 56.

To assemble the carton 12 using the blank 10, the blank 10 is folded at fold lines 24, 32, 40 and 46. Bottom flaps 64*a* through 64*e* are folded inward to form the bottom 66. The front panel 14 includes a removable tab 72. The removable tab 72 is connected to the front panel 14 by perforations 74 or the like to facilitate detachment. The removable tab 72, the third side panel 42 and its associated bottom flap 64*a* and top flap 68*a* each have glue patterns 76 on their outer surfaces. Second side panel 34 is folded over the third side panel 42 such that glue pattern 76 of the third side panel 42 adheres to the inside surface of the second side panel 34, and the glue pattern 76 on the bottom flap 64*a* of the third side panel 42 adhere to another of the bottom flaps 64*b* through 64*e* to form three sides of the carton 12. To complete formation of the carton 12, detachable panel 56 is folded over the front panel 14 such that the glue pattern 76 on the removable tab 72 adheres to the inner surface of the detachable panel 56, and the glue pattern 76 on the top flap 68*a* of the third side panel 42 adheres to the top flap 68*e* of the detachable panel 42 to form the top of the carton 12.

The detachable panel 56 is positioned to cover and protect graphics 75 on the product 77 stored within the carton 12 during shipment. When the detachable panel 56 is removed at a retail location, the graphics 75 are displayed. To convert the carton 12 to a display, as shown in FIG. 9, the intermediate panel 48 includes a cutout section 78. It also includes a zippered seam 80 at its first side edge 50 that cooperates with the second edge 52 of the second side panel 34. The user pulls the cutout section 78 outward such that the zippered seam 80 detaches the intermediate panel 48 from the second side panel 34. A second edge 82 of the detachable panel 56 also includes a cutout section 84. The user pulls cutout section 84 outward with a force that detaches the removable tab 72 from the front panel 14. The top flap 68*e* of the detachable panel 56 also includes a cutout section 86. The user pulls the cutout section 86 outward to remove the top flap 68*a* of the third side panel 42. The detachable panel 56 also includes perforations at its first side edge 58 that permits detachment from the intermediate panel 48. The carton 12 can now act as a display as the front panel 14 also includes a window section 88.

Figure 2:
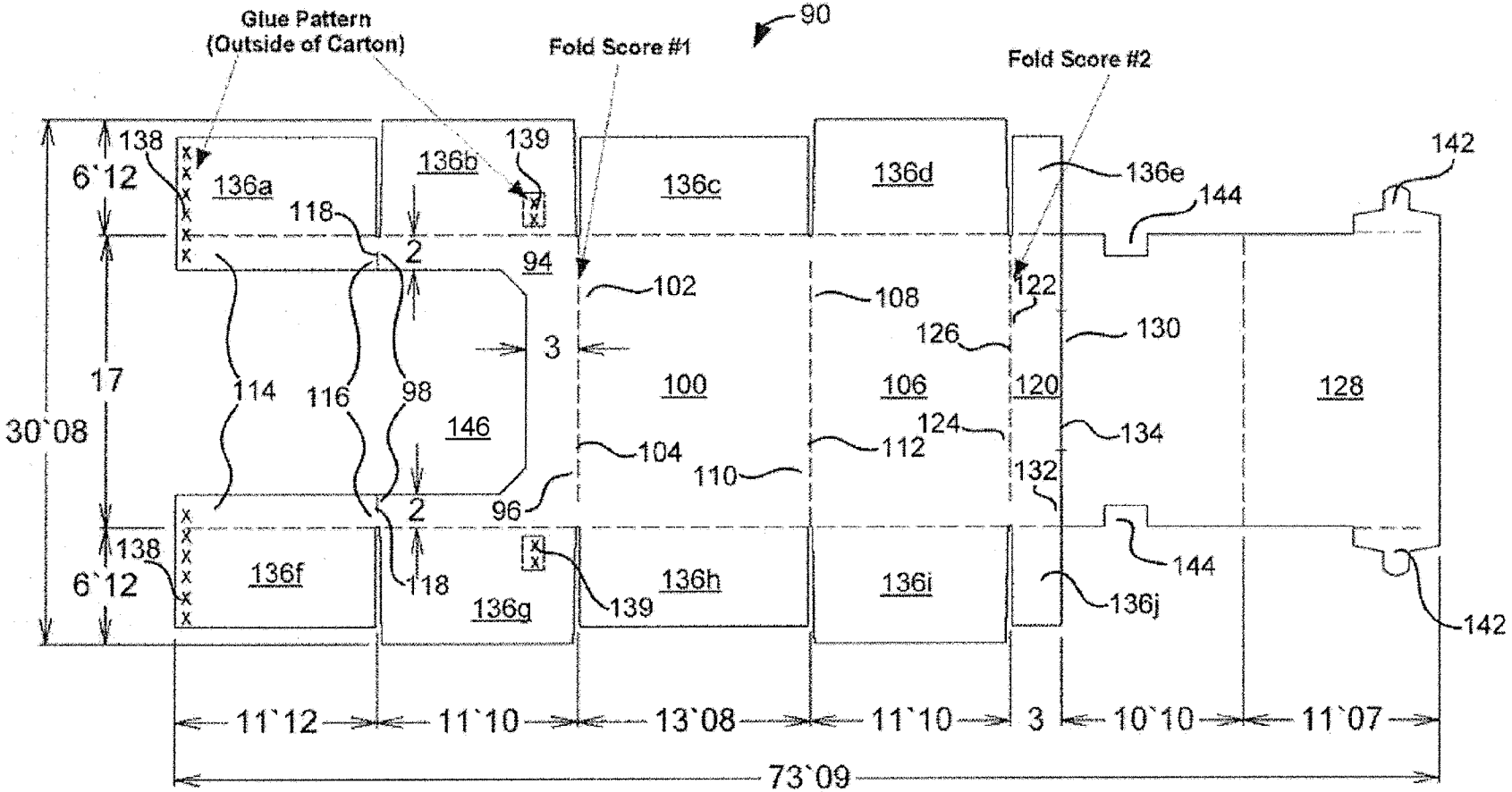
FIG. 2 is a top plan view of a carton blank in accord with a second embodiment of the present invention.
Figure 6:
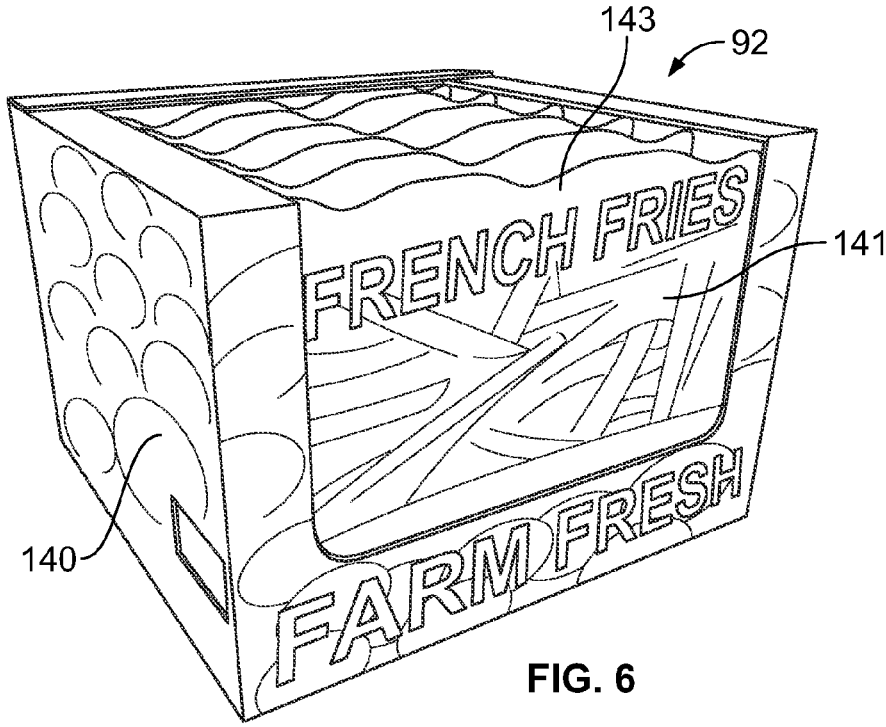
FIG. 6 is a perspective view of a carton formed from the blank of FIG. 2.
Figure 10:
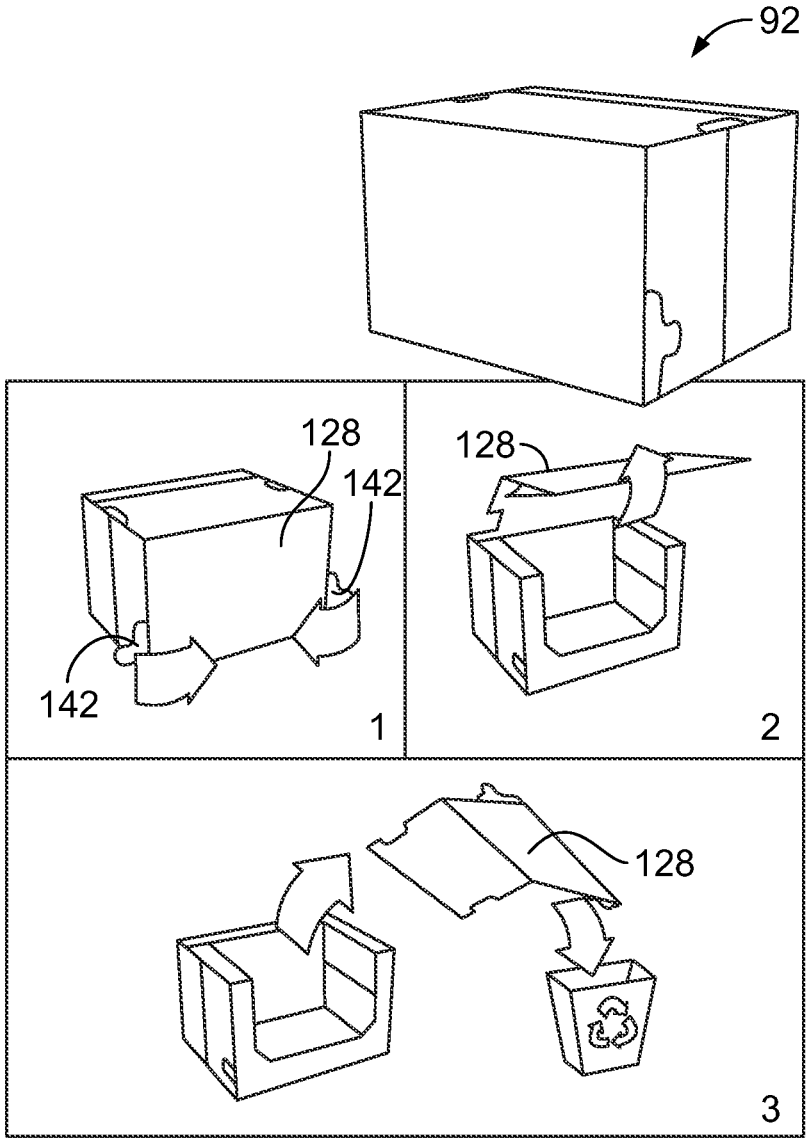
FIG. 10 is an assembly drawing showing how to convert the assembled carton of FIG. 6 into a retail display in accord with an embodiment of the present invention.

In another embodiment shown in FIGS. 2, 6, and 10, a carton 92 and a blank 90 for forming the carton 92 are provided. FIG. 2 shows the interior side of the blank 90. The blank 90 includes a front panel 94 having a first side edge 96 and a second side edge 98. It also includes a bottom panel 100 having a first side edge 102 attached to the first side edge 96 of the front panel 94 along a fold line 104. A rear panel 106 having a first side edge 108 is attached to a second side edge 110 of the bottom panel 100 along a fold line 112. A top panel 114 having a first side edge 116 is attached to the second side edge 98 of the front panel 94 along a fold line 118. An intermediate panel 120 having a first side edge 122 is attached to a second side edge 124 of the rear panel 106 along a fold line 126. A detachable panel 128 having a first side edge 130 is attached to a second side edge 132 of the intermediate panel 120 along a fold line 134.

To form the carton 92 with the blank 90, the blank 90 is folded upward at fold lines 104, 112, 118, 126, and 134. Side flaps 136*a* through 136*j*, attached to each of the front panel 94, bottom panel 100, rear panel 106, intermediate panel 120, and top panel 114 are folded inward. The intermediate panel 120 attaches by adherence to the top panel 114 by glue patterns 138 on exterior surfaces of the top panel 114 and its side flaps 136*a* and 136*f*. The side flaps 136*a* and 136*f* of the top panel 114 are the last to be folded and adhere to side flaps 136*d* and 136*i* of the rear panel 106 to form sides 140 of the carton 92. The detachable panel 128 is folded over the top of the carton 92 such that tabs 142 on the detachable panel 128 align with glue sections 139 on the exterior surfaces of the side flaps 136*b* and 136*g* of the front panel 94, thereby creating the carton 92.

The detachable panel 128 is positioned to cover and protect graphics 141 on the product 143 stored within the carton 92 during shipment. When the detachable panel 128 is removed at a retail location, the graphics 141 are displayed. To convert the carton 92 to a display, as shown in FIG. 10, the user detaches the tabs 142 from the glue sections 138 and the detachable panel 128 is lifted upward. The detachable panel 128 includes cutout sections 144 and is perforated at its first side edge 130 where it meets the intermediate panel 120 along fold line 134. The user tears the detachable panel 128 from the intermediate panel 120 along the perforations using the cutout sections 144. The front panel 94 includes a window 146 to display the contents. FIG. 6 shows the carton 92 after the detachable panel 128 has been removed.

Figure 3:
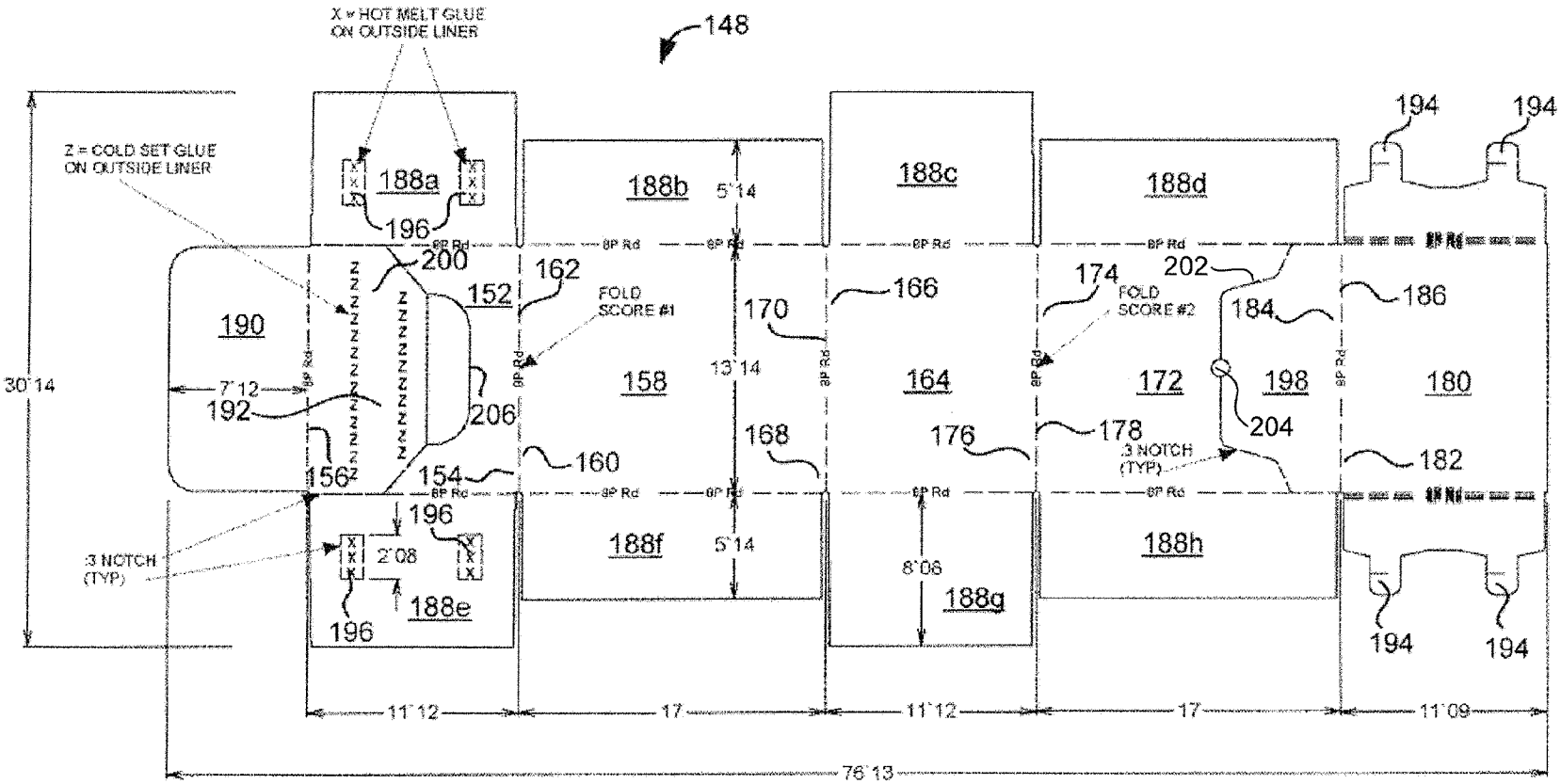
FIG. 3 is a top plan view of a carton blank in accord with a third embodiment of the present invention.
Figure 7:
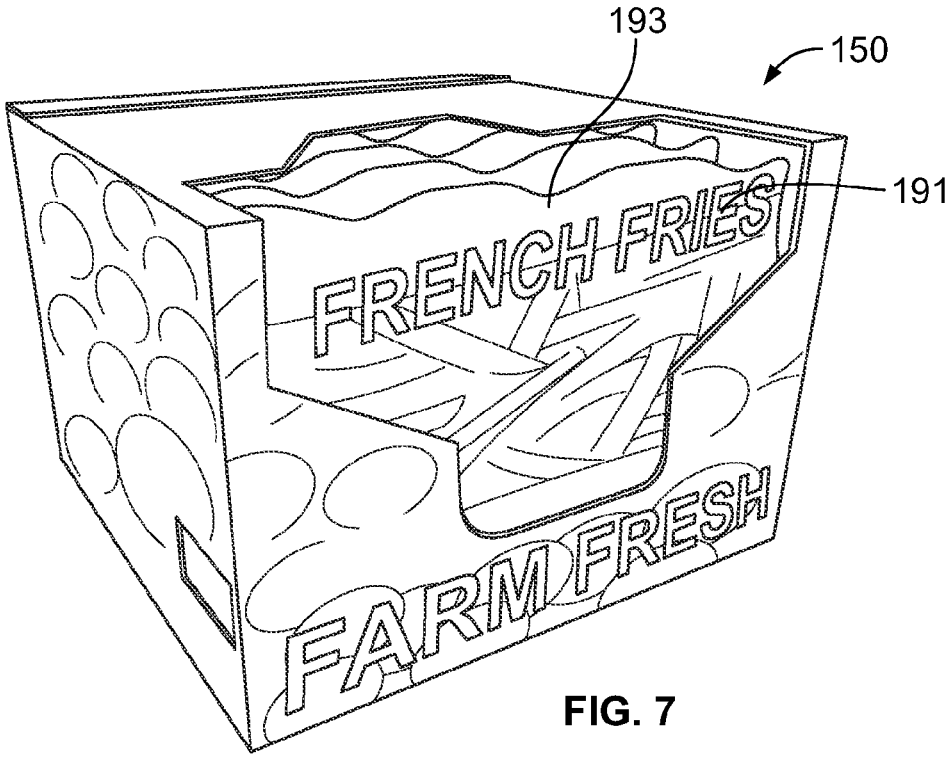
FIG. 7 is a perspective view of a carton formed from the blank of FIG. 3.
Figure 11:
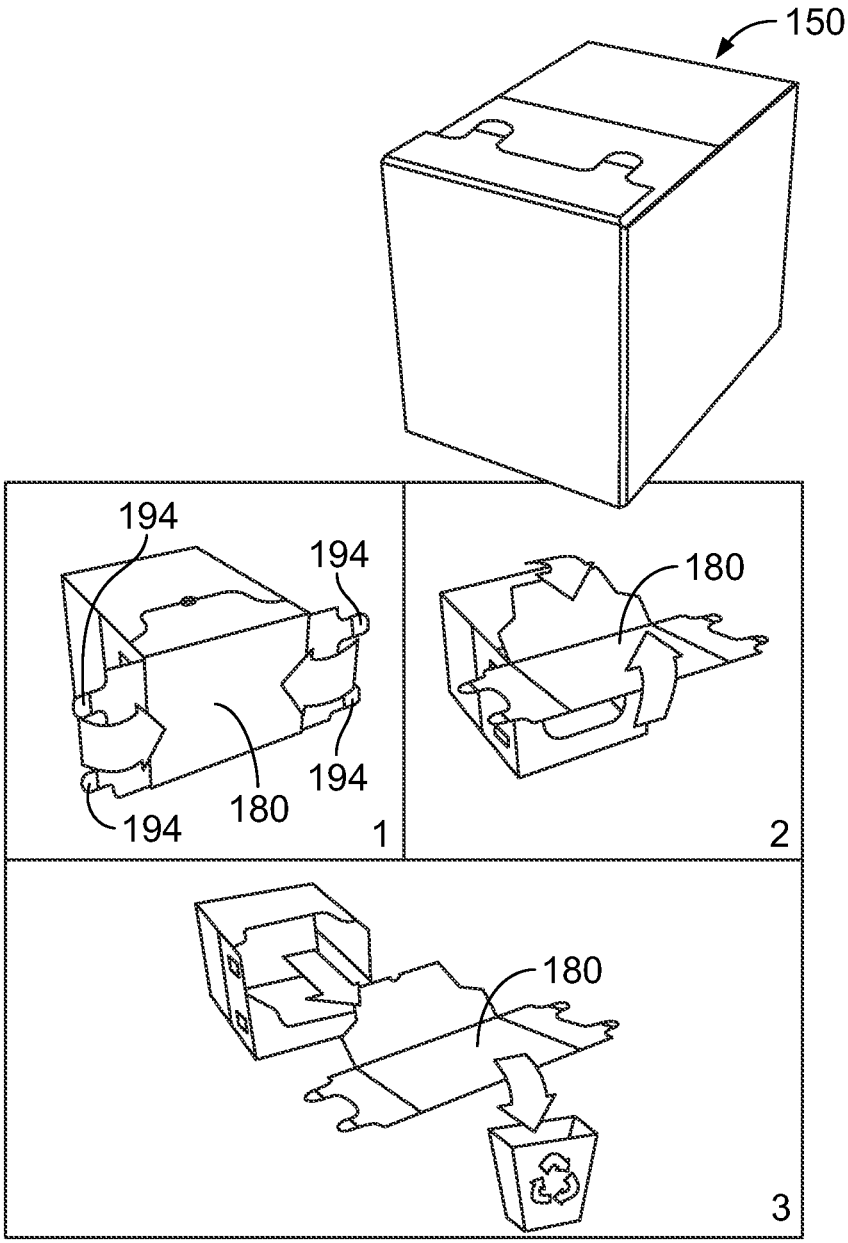
FIG. 11 is an assembly drawing showing how to convert the assembled carton of FIG. 7 into a retail display in accord with an embodiment of the present invention; and, FIG. 12 is an assembly drawing showing how to convert the assembled carton of FIG. 8 into a retail display in accord with an embodiment of the present invention.

In a further embodiment as shown in FIGS. 3, 7, and 11, a carton 150 and a blank 148 for forming the carton 150 are provided. FIG. 3 shows the interior side of the blank 148. The blank 148 includes a front panel 152 having a first side edge 154 and a second side edge 156. It also includes a bottom panel 158 having a first side edge 160 attached to the first side edge 154 of the front panel 152 along a fold line 162. A rear panel 164 having a first side edge 166 is attached to a second side edge 168 of the bottom panel 158 along a fold line 170. A top panel 172 having a first side edge 174 is attached to a second side edge 176 of the rear panel 164 along a fold line 178. A detachable panel 180 having a first side edge 182 is attached to a second side edge 184 of the top panel 172 along a fold line 186.

To form the carton 150, the blank 148 is folded upward at fold lines 162, 170, 178 and 186. Side flaps 188*a* through 188*h*, attached to each of the front panel 152, bottom panel 158, rear panel 164, and top panel 172 are folded inward. The side flaps 188*a* through 188*h* are glued to form the carton 150. The front panel 152 includes a safety flap 190. The detachable panel 180 is folded over the outside of the front panel 152, and is attached to the front panel 152 at glued section 192 on the outside surface of the front panel 152. Tabs 194 on the detachable panel 180 are adhered at glued sections 196 on the outer surface of side flaps 188*a* and 188*e* attached to the front panel 152.

The detachable panel 152 is positioned to cover and protect graphics 191 on the product 193 stored within the carton 150 during shipment. When the detachable panel 152 is removed at a retail location, the graphics 191 are displayed. To convert the carton 150 to a display, as shown in FIG. 11, tabs 194 are pulled outward and detached from glued sections 196. The user lifts the detachable panel 180. The top panel 172 includes a detachable window section 198. The front panel 152 also includes a detachable window section 200. The window section 198 includes perforations 202 to permit them to be removed from the top panel 172 using a finger hole 204. The window section 200 is also perforated at 206. Lifting the detachable panel 180 also tears the perforations 206 to permit contents of the carton 150 to be displayed. FIG. 7 shows the carton 150 with the detachable panel 180 removed.

Figure 4:
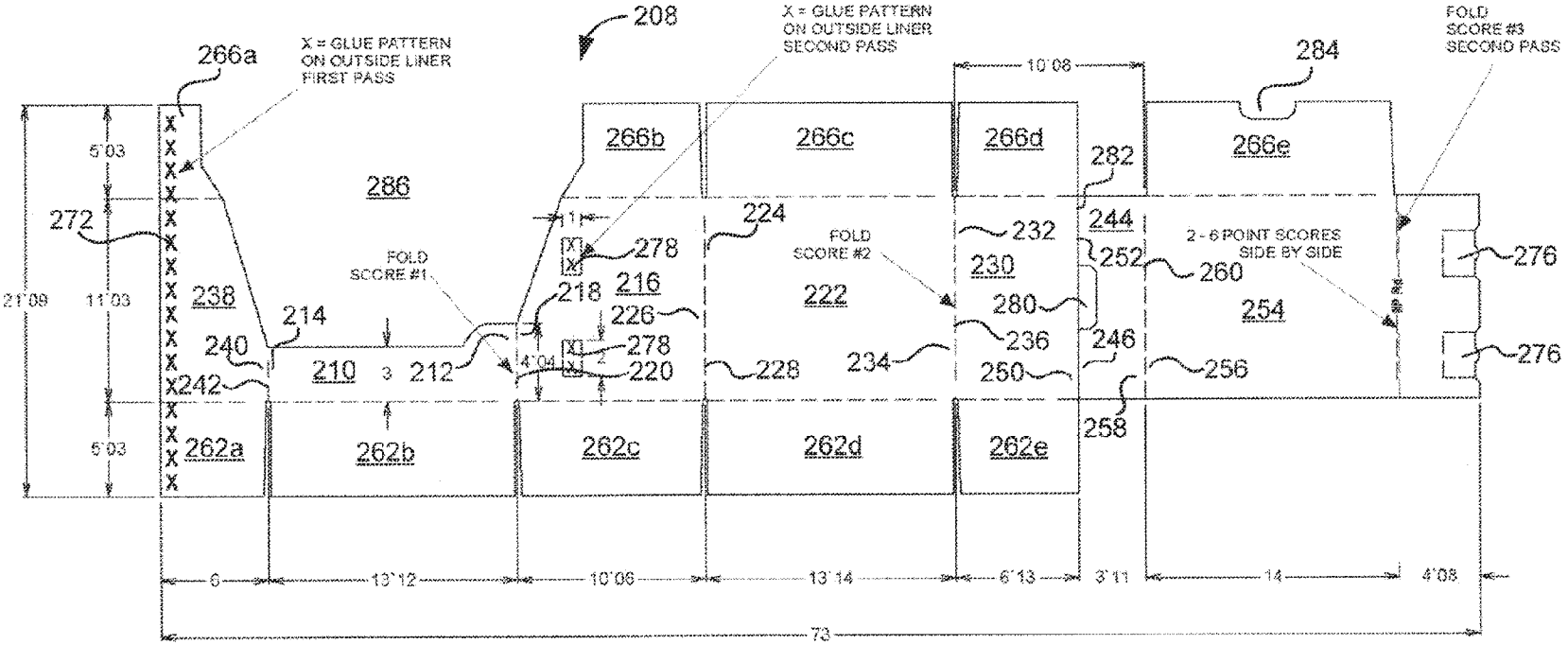
FIG. 4 is a top plan view of a carton blank in accord with a fourth embodiment of the present invention.
Figure 8:
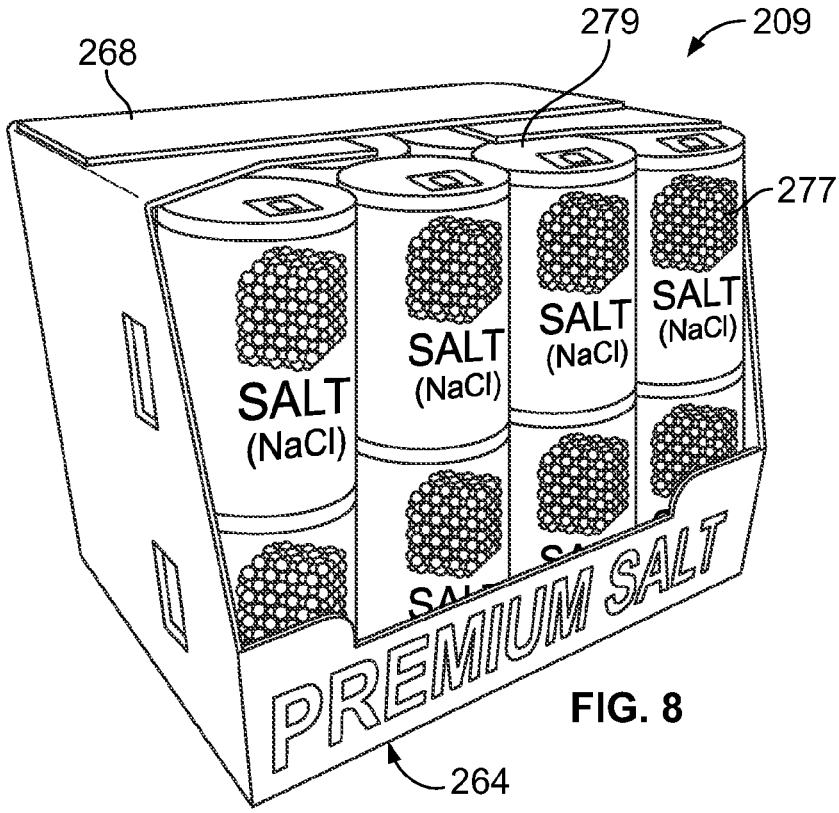
FIG. 8 is a perspective view of a carton formed from the blank of FIG. 4.
Figure 12:
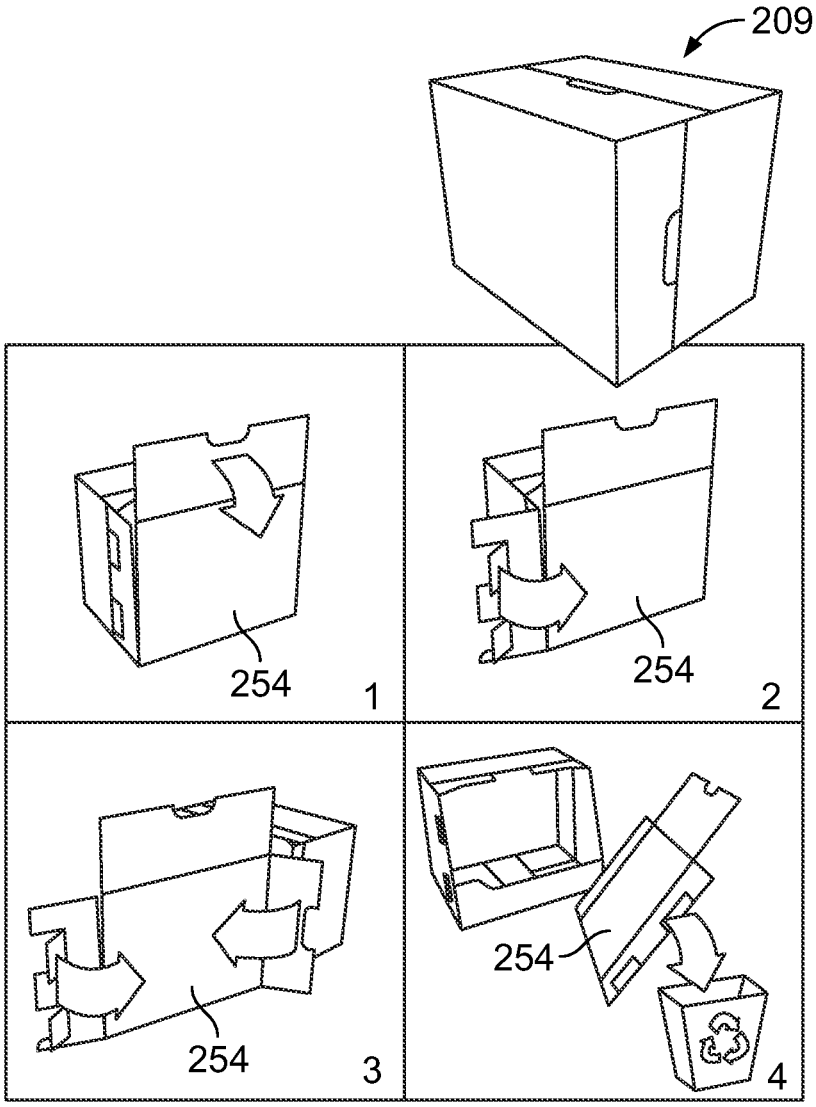

In another embodiment shown in FIGS. 4, 8, and 12, a carton 209 and a blank 208 for forming the carton 209 are provided. FIG. 4 shows the interior side of the blank 208. The blank 208 includes a front panel 210 having a first side edge 212 and a second side edge 214. A first side panel 216 having a first side edge 218 is attached to the first side edge 212 of the front panel 210 along a fold line 220. A rear panel 222 having a first side edge 224 is attached to a second side edge 226 of the first side panel 216 along a fold line 228. A second side panel 230 having a first side edge 232 is attached to a second side edge 234 of the rear panel 222 along a fold line 236. A third side panel 238 having a first side edge 240 is attached to the second side edge 214 of the front panel 210 along a fold line 242. An intermediate panel 244 having a first side edge 246 is attached to a second side edge 250 of the second side panel 230 along a fold line 252. A detachable panel 254 having a first side edge 256 is attached to a second side edge 258 of the intermediate panel 244 along a fold line 260.

Each of the front panel 210, first side panel 216, rear panel 222, second side panel 230, and third side panel 238 include downward extending bottom flaps 262*a* through 262*e* for forming a bottom 264 of the finished carton 209. Each of the first side panel 216, rear panel 222, second side panel 230, detachable panel 254, and third side panel 238 include upwardly extending top flaps 266*a* through 266*e* for forming a portion of a top 268 of the finished carton 210.

To assemble the carton 209 using the blank 208, the blank 208 is folded at fold lines 220, 228, 236, 242, and 260. Bottom flaps 262*a* through 262*e* are folded inward to form the bottom 264. The third side panel 238 and its associated bottom flap 262*a* and top flap 266*a* each have glue patterns 272 on their outer surfaces. Second side panel 230 is folded over the third side panel 238 such that glue pattern 272 of the third side panel 238 adheres to the inside surface of the second side panel 230, and the glue pattern 272 on the bottom flap 262*a* of the third side panel 238 adhere to another of the bottom flaps 262*b* through 262*e* to form three sides of the carton 209. To complete formation of the carton 209, detachable panel 254 is folded over the front panel 210 such that the glue pattern 272 on the top flap 266*a* of the third side panel 238 adheres to the top flap 268*e* of the detachable panel 254 to form the top 268 of the carton 209. The detachable panel 254 is folded such that tabs 276 on the detachable panel 254 align with glue sections 278 on the outer surface of the second side panel 230, thereby creating the carton 209.

The detachable panel 254 is positioned to cover and protect graphics 277 on the product 279 stored within the carton 209 during shipment. When the detachable panel 254 is removed at a retail location, the graphics 277 are displayed. To convert the carton 209 to a display, as shown in FIG. 12, the intermediate panel 244 includes a cutout section 280. It also includes a zippered seam 282 at its first side edge 246 that cooperates with the second side edge 250 of the second side panel 230. The tabs 276 are pulled from the glue sections 278. The top flap 268*e* of the detachable panel 254 also includes a cutout section 284. The user pulls the cutout section 284 outward to remove the top flap 262*e* from the third side panel 238. The user pulls the cutout section 280 outward such that the zippered seam 282 detaches the intermediate panel 244 from the second side panel 230. The detachable panel 254 also includes perforations at its first side edge 256 that permits detachment from the intermediate panel 244. The carton 209 can now act as a display as the front panel 210 also includes a window section 286. FIG. 11 shows the carton 209 with the detachable panel 254 removed.

Many modifications and variations of the present invention are possible in light of the above teachings. It is, therefore, to be understood within the scope of the appended claims the invention may be protected otherwise than as specifically described.

We claim:

1. A foldable carton comprising:

a front panel having a first side edge positioned adjacent a first side portion of the front panel and a second side edge positioned adjacent a second side portion of the front panel, the first side portion of the front panel connected to a first side of a central lower portion of the front panel and the second side portion of the front panel connected to a second side of the central lower portion of the front panel, the first side portion of the front panel separated from the second side portion of the front panel by an opening;

a removable tab extending into the opening of the front panel from the first side portion of the front panel wherein the removable tab is above the central lower portion of the front panel;

a first side panel having a first side edge and a second side edge, the first side edge of the first side panel attached to the first side edge of the front panel;

a rear panel having a first side edge and a second side edge, the first side edge of the rear panel attached to the second side edge of the first side panel;

a second side panel having a first side edge and a second side edge, the first side edge of the second side panel attached to the second side edge of the rear panel;

a third side panel having a first side edge attached to the second side edge of the front panel;

an intermediate panel having a first side edge and a second side edge, the first side edge of the intermediate panel attached to the second side edge of the second side panel; and a detachable panel having a perforated first side edge and a second side edge, the first side edge of the detachable panel attached to the second side edge of the intermediate panel, and an interior surface of the detachable panel secured to an outer surface of the removable tab extending into the opening of the front panel; wherein the first side panel forms a first side of the carton, and the second side panel and the third side panel collectively form a second side of the carton opposing the first side of the carton.

2. The foldable carton of claim 1 wherein the opening extends to a top edge of the front wall.

3. The foldable carton of claim 1 wherein the carton is formed from a single blank of material.

4. The foldable carton of claim 3 wherein the blank is formed from one of plastic and paper.

5. The foldable carton of claim 1 wherein the intermediate panel includes a hand opening adjacent the second side panel, the hand opening for enabling one to grasp and detach the intermediate panel and detachable panel from the carton.

6. The foldable carton of claim 1 wherein the detachable panel includes an indentation adjacent the second side edge of the detachable panel.

7. The foldable carton of claim 1 wherein the third side panel includes a glue portion.

8. The foldable carton of claim 1 wherein the removable tab includes a glue portion that secures the detachable panel to the removable tab.

9. The foldable carton of claim 1 further comprising a plurality of top flaps connected respectively to a top end of the front panel, first side panel, second side panel and third side panel for forming a top of the carton and a plurality of bottom flaps connected respectively to a bottom end of the front panel, first side panel, second side panel and third side panel for forming a bottom of the carton.

10. The foldable carton of claim 1 wherein the detachable panel includes a first side tab for gluing to another panel.

11. The foldable carton of claim 1 wherein the opening extends to a side edge of the front panel.

12. A convertible carton formed from a single blank of material comprising:

a front panel having a first side portion, a central portion and a second side portion, and an opening separating the first side portion and the second side portion, a bottom edge and a top edge;

a removable tab extending from the first side portion into the opening of the front panel;

a bottom panel having a front edge connected to the bottom edge of the front panel and a rear edge;

a rear panel having a bottom edge connected to the rear edge of the bottom panel and a top edge;

an intermediate panel having a first edge connected to the top edge of the rear panel and an opposing second edge;

a detachable panel having a perforated edge connected to the second edge of the intermediate panel, and an interior surface of the detachable panel secured to the removable tab extending into the opening of the front panel;

a first top panel segment a front edge connected to a first side of the top edge of the front panel; and, a second top panel segment separated from the first top panel segment by an opening, the second top panel segment having a front edge connected to a second side of the top edge of the front panel.

13. The convertible carton of claim 12 wherein the carton is formed from a single blank of material.

14. The convertible carton of claim 13 wherein the blank is formed from one of plastic and paper.

15. The convertible carton of claim 12 further comprising a side flap extending from a first side of the front panel and a second side flap extending from a second side of the front panel, the first side flap including a first glue portion and the second side flap including a second glue portion.

16. The convertible carton of claim 15 wherein the detachable panel includes a first side tab extending outward from a first side of the detachable panel and a second side tab extending outward from a second side of the detachable panel, the first side tab positioned to contact the first glue portion of the first side flap and the second side tab positioned to contact the second glue portion of the second side flap.

17. The convertible carton of claim 12 further comprising a first hand-hold cut-out on a first side of the detachable panel and a second hand-hold cut-out on a second side of the detachable panel.

18. The convertible carton of claim 12 wherein the first top panel segment includes a glue portion proximate a rear edge, and the second top panel segment includes a glue portion proximate a rear edge.

* * * * *